US010167184B1

(12) United States Patent
Samples

(10) Patent No.: US 10,167,184 B1
(45) Date of Patent: Jan. 1, 2019

(54) MULTIPLE BEVERAGE DISPENSING COOLER

(71) Applicant: Bob Samples, Augusta, GA (US)

(72) Inventor: Bob Samples, Augusta, GA (US)

( * ) Notice: Subject to any disclaimer, the term of this patent is extended or adjusted under 35 U.S.C. 154(b) by 0 days.

(21) Appl. No.: 15/904,985

(22) Filed: Feb. 26, 2018

Related U.S. Application Data

(60) Provisional application No. 62/464,420, filed on Feb. 28, 2017.

(51) Int. Cl.

| | |
|---|---|
| ***F25C 5/20*** | (2018.01) |
| ***A47F 1/12*** | (2006.01) |
| ***B67D 3/00*** | (2006.01) |
| ***B65D 81/38*** | (2006.01) |
| ***B65D 25/28*** | (2006.01) |

(52) U.S. Cl.
CPC ..... *B67D 3/0029* (2013.01); *A47F 1/123* (2013.01); *B65D 25/28* (2013.01); *B65D 81/3825* (2013.01); *B67D 3/0012* (2013.01); *F25C 5/20* (2018.01); *B67D 2210/00031* (2013.01); *B67D 2210/00078* (2013.01); *B67D 2210/00133* (2013.01)

(58) Field of Classification Search
CPC ..... B67D 3/0029; B67D 3/0012; B67D 2210/00031; B67D 2210/00078; B67D 2210/00133; F25C 5/20; A47F 1/123; B65D 25/28; B65D 81/3825
USPC ..... 222/129.1; 62/457.1, 457.4, 457.7, 457.8
See application file for complete search history.

(56) References Cited

U.S. PATENT DOCUMENTS

| | | | | |
|---|---|---|---|---|
| 3,395,550 | A * | 8/1968 | Dungan | F25D 3/08 62/400 |
| 4,641,763 | A * | 2/1987 | Landers | B67D 1/0857 222/129.1 |
| 4,997,109 | A * | 3/1991 | Carper | F25C 5/20 222/146.6 |
| 5,456,387 | A | 10/1995 | Trewhella | |
| 6,047,866 | A * | 4/2000 | Brown | B05B 9/007 222/481 |
| 6,463,756 | B1 * | 10/2002 | Lewis | A45D 19/02 62/371 |
| 6,758,047 | B1 * | 7/2004 | Giles | F25C 5/007 222/146.6 |
| 6,814,383 | B2 | 11/2004 | Reed, III et al. | |

(Continued)

OTHER PUBLICATIONS

Waterboy Sports 4 Station Gravity Fed Drinking Nozzle w/ 10 Gal Cooler, Price/Each. Product listing [online]. Copyright © 2004-2018 Opentip.com [retrieved on Nov. 30, 2016]. Retrieved from the Internet: <URL: https://www.opentip.com/product.php?products_id=998759&gclid=CPiA8aOJz9ACFU5XDQodfWIFVQ>.

(Continued)

*Primary Examiner* — Benjamin R Shaw
(74) *Attorney, Agent, or Firm* — Cramer Patent & Design, PLLC; Aaron R. Cramer

(57) ABSTRACT

A multiple beverage dispensing system is housed within an ice chest having a plurality of interior sections and a lid. Within a central section is an ice screw which is configured to pull ice stored within the central section out of the device through an exterior door. The other two (2) exterior sections house a plurality of cylindrical fluid dispensing containers. Each container is plumbed to be in communication with an individual exterior tap. Each tap is disposed adjacent the exterior ice door.

20 Claims, 7 Drawing Sheets

(56) References Cited

U.S. PATENT DOCUMENTS 7,275,664 B2 * 10/2007 Pickrell ..... B65G 33/32 222/1
7,389,608 B1 * 6/2008 MacKay ..... A01K 97/05 206/315.11
8,256,156 B1 * 9/2012 Burgoyne, Jr. ..... A01K 97/06 206/315.11
9,199,782 B1 * 12/2015 Cliatt ..... B65D 81/3813
2006/0124665 A1 * 6/2006 Prabucki ..... B67D 1/0869 222/129.1
2006/0248911 A1 * 11/2006 An ..... F25C 5/20 62/344
2007/0101754 A1 * 5/2007 Maldonado ..... B67D 3/0067 62/389
2007/0125118 A1 * 6/2007 Hooper ..... B67D 1/0857 62/389
2008/0245095 A1 * 10/2008 Schlipman ..... A45C 5/065 62/457.1
2008/0245793 A1 * 10/2008 Hanson ..... A45C 11/20 220/263
2009/0241584 A1 * 10/2009 Hayes ..... B67D 3/0009 62/390
2010/0005811 A1 1/2010 Jaffe et al.
2010/0212351 A1 * 8/2010 Chapin ..... F25D 3/08 62/457.5
2011/0017776 A1 * 1/2011 Metropulos ..... B67D 1/0041 222/129.1
2011/0168738 A1 * 7/2011 Nevarez ..... G07F 13/065 222/129.1
2011/0197625 A1 * 8/2011 Urban ..... B62B 5/067 62/457.1
2013/0306680 A1 * 11/2013 Bamberger ..... F25C 5/20 222/238
2014/0034666 A1 * 2/2014 Woods ..... A47F 1/121 221/267
2014/0209634 A1 * 7/2014 Metropulos ..... B67D 1/0036 222/129.1
2015/0122831 A1 * 5/2015 Wang ..... F16K 35/025 222/1
2016/0054045 A1 * 2/2016 Sassman ..... F25D 3/08 280/63
2016/0068381 A1 * 3/2016 Ploss ..... B67D 1/0887 221/1
2016/0338507 A1 * 11/2016 Morrow ..... A47F 1/065
2017/0101301 A1 * 4/2017 Volin ..... B67D 1/0857
2018/0015938 A1 * 1/2018 DeFrancia ..... A45C 13/02
2018/0055218 A1 * 3/2018 Mueller ..... A47B 3/06

OTHER PUBLICATIONS

2 Tap Jockey Box Cold Plate Cooler. Product listing [online]. Copyright © 2018 Rapids Wholesale Equipment [retrieved on Nov. 30, 2016]. Retrieved from the Internet: <URL: https://rapidswholesale.com/american-beverage-two-product-cold-plate-cooler.html?gclid=CKHc7eGHz9ACFU5MDQodJvQP1w>.

* cited by examiner

MULTIPLE BEVERAGE DISPENSING COOLER

RELATED APPLICATIONS

The present invention is a continuation of, was first described in and claims the benefit of U.S. Provisional Application No. 62/464,420 filed Feb. 28, 2017, the entire disclosures of which are incorporated herein by reference.

FIELD OF THE INVENTION

The present invention relates generally to the field of a cooler capable of dispensing a selected beverage container therein.

BACKGROUND OF THE INVENTION

Alcoholic drinks are the favorite beverage of many people. The wide variety of liquors and spirits when mixed with fruit juices, sodas, sweet and sour mixes, and the like, form the basis of a multitude of mixed drinks. Such drinks are often served with ice which is not an issue in a permanent indoor environment such as a home, restaurant, or bar. However, a good many of such drinks are enjoyed while outdoors doing activities such as picnicking, camping, boating, watching sports, or simply relaxing in the backyard. Many people utilize portable coolers to hold ice as well as the mixing beverages, and, while such an arrangement works, it is clumsy, time consuming to use, and generally detracts from the enjoyable experiences outlined above. Accordingly, there exists a need for a means by which mixing beverages for alcoholic beverages as well as ice can be made easy to access and use while keeping cold as well. The development of the portable beverage and ice dispenser fulfills this need.

SUMMARY OF THE INVENTION

The principles of the present invention provide for a portable beverage dispenser, comprising an insulated cooler body having a cooler body interior; a lid which is removably secured over a cooler body open top, a handle assembly affixed to a cooler body first sidewall, an ice reservoir located within the cooler body interior, having an ice reservoir interior; an ice dispenser in operable communication with the ice reservoir interior and in fluid communication with an ice dispenser opening disposed within a cooler body second sidewall, at least one (1) drawer slidably engaging with the cooler body second sidewall, a cup dispenser affixed to a cooler body third sidewall and a drink stirrer affixed to the cooler body third sidewall adjacent the cup dispenser. Each beverage dispensing assembly comprises a beverage reservoir located within the cooler body interior and outside the ice reservoir and a dispensing device in operable communication with the beverage reservoir and in fluid communication with a beverage dispensing opening located on the cooler body second sidewall.

In separate embodiment, the portable beverage dispenser may also comprise a spring-loaded knob in operable communication with the beverage reservoir. Under this configuration, when the knob is actuated in a first direction, a beverage within the beverage reservoir is dispensed through a spout.

The ice dispenser may further comprise an ice drive mechanism which is disposed within the ice reservoir interior and an ice drive mechanism knob in mechanical communication with the ice drive mechanism. The ice drive mechanism knob is disposed on the cooler body second side wall superjacent the ice dispenser opening. When ice drive mechanism knob is actuated in a first direction, the ice drive mechanism directs a unit of ice within the ice reservoir interior towards the ice dispenser opening.

The beverage reservoir is supported by at least one support rod. An upper surface of the lid may further comprise at least one recessed beverage container holder. The device may also comprise at least one leg, each attached to a bottom of the cooler body and capable of being deployed between an extended state and a stowed state. The handle assembly is retractable. The device may also have a pair of caster wheels attached to a first edge of the bottom of the cooler body. The cup dispenser may further comprise a first bracket which is secured to the cooler body third sidewall and a holding tube which is secured within the first bracket. A quantity of cups may be removably secured within the holding tube.

The drink stirrer may comprise a second bracket which is secured to the cooler body third sidewall adjacent the first bracket; a stirring rod moveably secured within the second bracket and a handle secured to a stirring rod upper end. Each of the beverage reservoirs has a corresponding beverage reservoir lid which is capable of securing about an upper opening.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
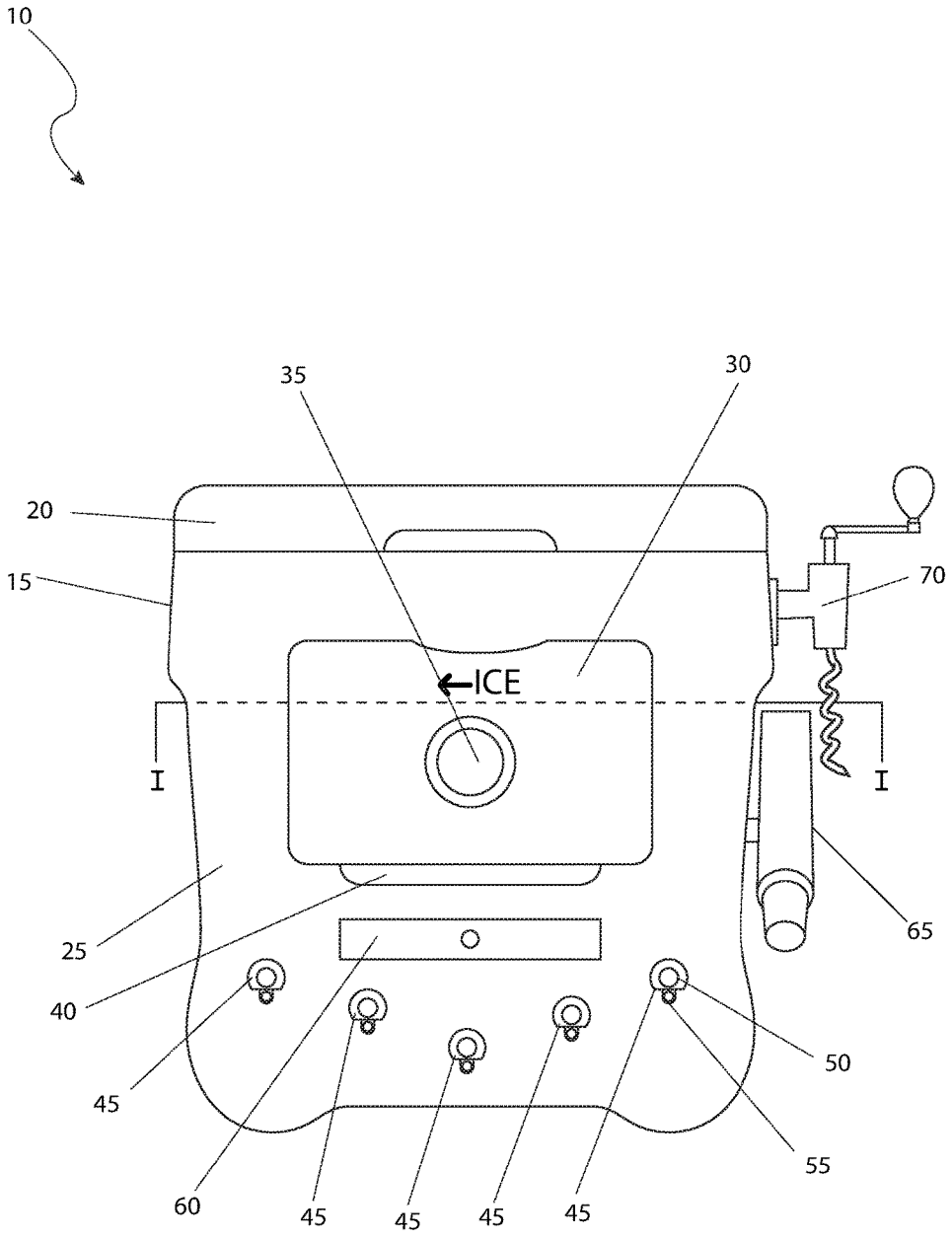
FIG. 1 is a front view of the portable beverage and ice dispenser 10, according to the preferred embodiment of the present invention.

10 portable beverage and ice dispenser
15 cooler body
20 removable lid
25 insulated sidewall
30 ice dispenser
35 dispensing knob
40 dispensing opening

45 beverage dispensing spigot
50 spring loaded dispensing knob
55 spout opening
60 access drawer
65 cup dispenser
70 drink stirrer
75 molded drink holder
80 retractable pulling handle
85 caster wheels
90 extendable folding leg
95 corner
100 disposable cup
105 travel path "c"
110 holding tube
115 compressed edge
120 first slide bracket
125 second slide bracket
130 base
135 upper crank handle
140 stirring rod
145 travel path "r'
150 ice reservoir
155 ice drive mechanism
160 travel path "i"
165 beverage reservoir
170 reservoir cover
175 connection tube
180 support rod

DETAILED DESCRIPTION OF THE PREFERRED EMBODIMENT

The best mode for carrying out the invention is presented in terms of its preferred embodiment, herein depicted within FIGS. 1 through 7. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

Referring now to FIG. 1, a front view of the portable beverage and ice dispenser 10, according to the preferred embodiment of the present invention, is disclosed. The portable beverage and ice dispenser 10 (herein described as the "device") 10, includes of an otherwise conventional cooler body 15 complete with a removable lid 20. The cooler body 15 is provided with insulated sidewalls 25 that utilize an insulating material such as Styrofoam, air or the like. The side face of the cooler body 15 is provided with a manual ice dispenser 30 complete with a dispensing knob 35 as well as a dispensing opening 40 from which ice is dispensed into an awaiting glass. Further description of the ice dispenser 30 will be provided herein below. Below the ice dispenser 30 are five (5) beverage dispensing spigots 45 each consisting of a spring-loaded dispensing knob 50 and a spout opening 55 which operate in a well-known manner. Each of the beverage dispensing spigots 45 are independently connected to a separate reservoir on the interior of the portable beverage and ice dispenser 10, which will be described in greater detail herein below. The five (5) beverages dispensed can be those pre-selected from a wide variety including but not limited to: cola, lemon/lime soft drink, orange juice, water, sweet and sour mix, seltzer, and the like. These features provide the ability to obtain ice and a selected beverage in a glass, in much the same manner as a soft drink dispensing system as found in a restaurant. An access drawer 60 is located immediately below the beverage dispensing spigots 45 in the center of the device 10. It is used to hold various miscellaneous accessories associated with use of the device 10. Such accessories include but are not limited to straws, mixing sticks, lemon slices, lime slices, garnishments and the like. The right side of the device 10 is provided with a cup dispenser 65 and a drink stirrer 70. Further information regarding usage and functionality of the cup dispenser 65 and the drink stirrer 70 will be provided herein below.

Figure 2:
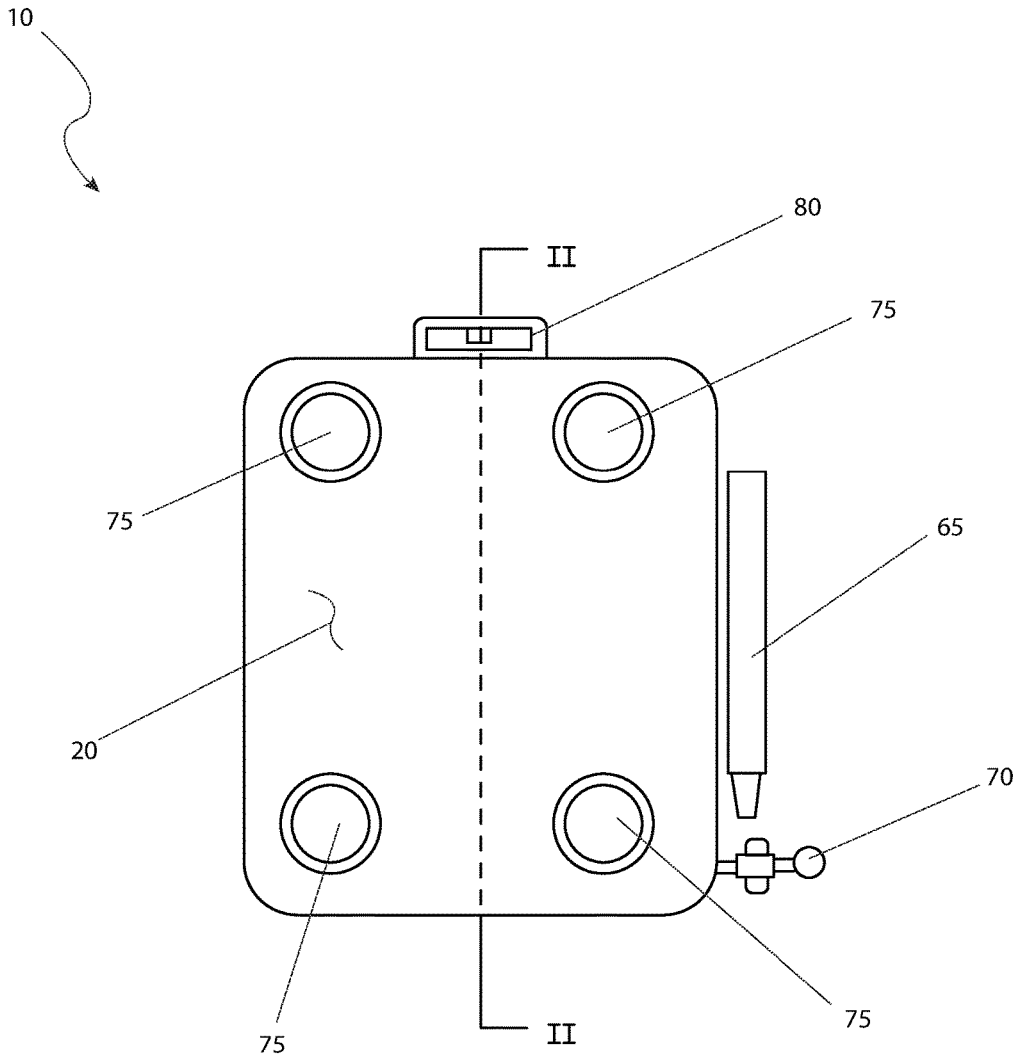
FIG. 2 is a top view of the portable beverage and ice dispenser 10, according to the preferred embodiment of the present invention.

Referring next to FIG. 2, a top view of the device 10, according to the preferred embodiment of the present invention is depicted. Said view presents a clear view of the removable lid 20. The removable lid 20 is provided with four (4) recessed molded drink holders 75 for the purposes of holding glasses before, during, or after use with the portable beverage and ice dispenser 10 and associated consumption. It is envisioned that the molded drink holders 75 would be of a tapered design that would hold glasses of a wide variety of sizes and shapes. The removable lid 20 is of a removable design this is held in place via a friction fit and allows for access, placement, and removal of objects from the interior of the cooler body 15 (as shown in FIG. 1). Also visible in this figure is a retractable pulling handle 80, which is pulled outward (towards the user), and used to transport the device 10. The retractable pulling handle 80, is similar in design and usage to retractable handles used on luggage, large computer cases, briefcases, sample cases, and the like, that are used in conjunction with bottom mounted wheels to move the container in much the same manner as a hand truck. The cup dispenser 65 and the drink stirrer 70 are visible as well.

Figure 3:
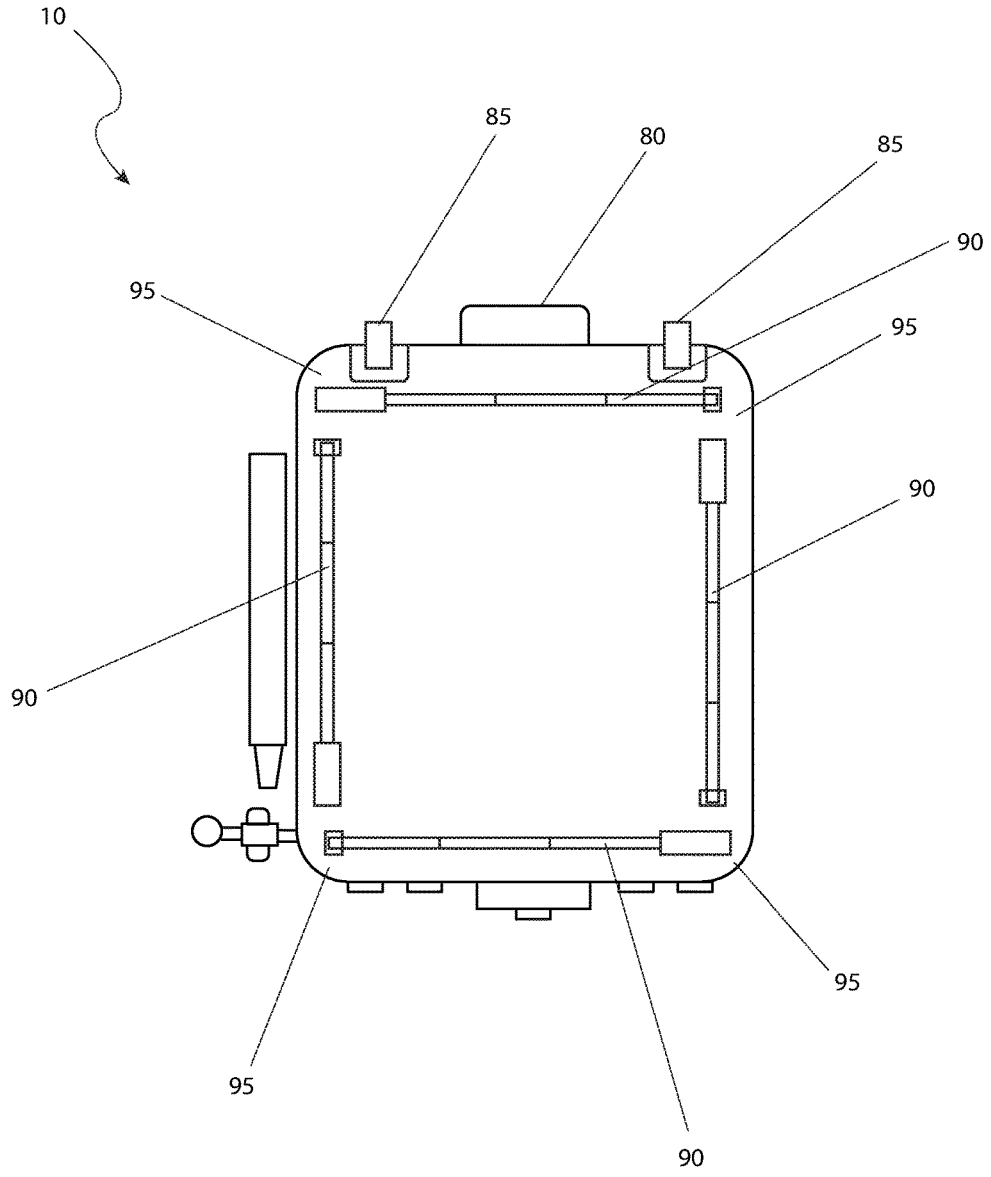
FIG. 3 is a bottom view of the portable beverage and ice dispenser 10, according to the preferred embodiment of the present invention.

Referring now to FIG. 3, a bottom view of the device 10, according to the preferred embodiment of the present invention is shown. The bottom of the device 10 provides for two (2) caster wheels 85 that are used in conjunction with the retractable pulling handle 80 to transport the device 10. The center of balance of the device 10 is centered on the vertical axis of the caster wheels 85 allowing for effortless movement in much the same manner as roller luggage. The bottom view of the device 10 also discloses four (4) extendable folding legs 90, one of each located in each corner 95. The extendable folding legs 90 as shown, are in a stowed and retracted position, as would be used for transporting or storage of the device 10. During utilization of the device 10, each extendable folding legs 90 would be folded outward and extended outward thus allowing the device 10 to be positioned at table height. This position allows for easy utilization of the device 10 in locations where suitable storage positions are not handy, such as backyards, patios, sporting events, tailgate parties, and the like. The extendable folding legs 90 are similar in nature to those found on conventional portable folding tables and are well known in the art. The use of any particular style, type, configuration, or method of retraction and folding is not intended to be a limiting factor of the present invention.

Figure 4:
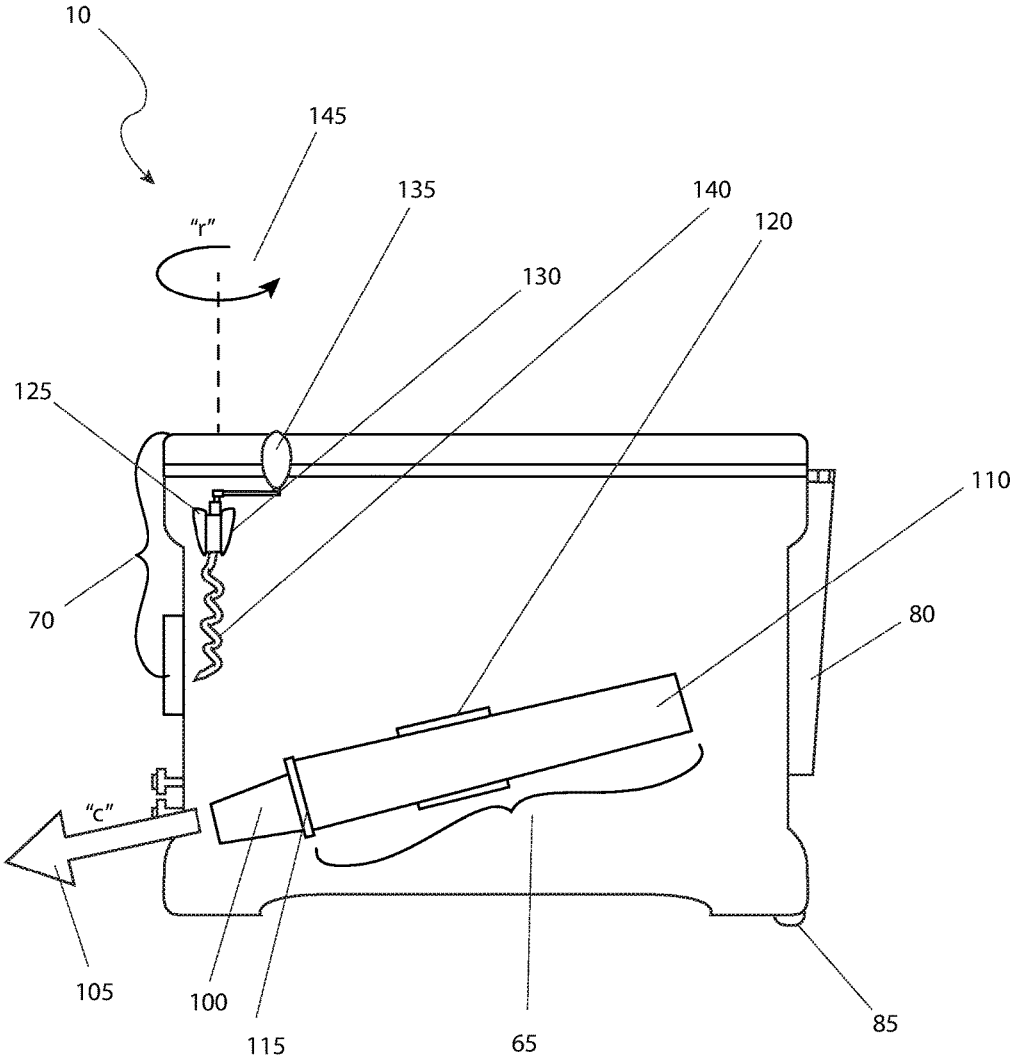
FIG. 4 is a right-side view of the portable beverage and ice dispenser 10, according to the preferred embodiment of the present invention.

Referring next to FIG. 4, a right-side view of the device 10, according to the preferred embodiment of the present invention is disclosed. This view provides further detail of the cup dispenser 65 and the drink stirrer 70. The cup dispenser 65 is used to hold a stack of disposable cups 100 in a normal configuration with the exposed portion of the disposable cups 100 extended outward and downward in relation to the front of the device 10. Disposable cups 100 are removed by pulling outward along a travel path "c" 105. Remaining disposable cups 100 are held inside of an adjacent disposable cup 100 via friction fit at a compressed edge 115. The holding tube 110 is affixed to the cooler body 15 by use of first slide bracket 120 that allow for the removal of the holding tube 110 as well as the disposable cups 100 for storage, transport or the like. In a similar manner, the drink stirrer 70 is provided at an upper forward corner of the cooler body 15. The drink stirrer 70 is held in place via a second slide bracket 125 to allow for the removal of the drink stirrer 70 for storage, transport or the like. The drink stirrer 70 includes a base 130 which hold an upper crank handle 135 and a stirring rod 140 in an axially connected direct drive configuration. The base 130 provides bearing capability as well. The user would hold a disposable cup 100 filled with ice, alcoholic beverage and a beverage as provided by one of the beverage dispensing spigots 45 such that the stirring rod 140 is inside of the disposable cups 100. Next, by turning the upper crank handle 135 along a travel path "r' 145 for several revolutions, the drink is mixed. Note that the retractable pulling handle 80 and caster wheels 85 are visible in this figure as well.

Figure 5:
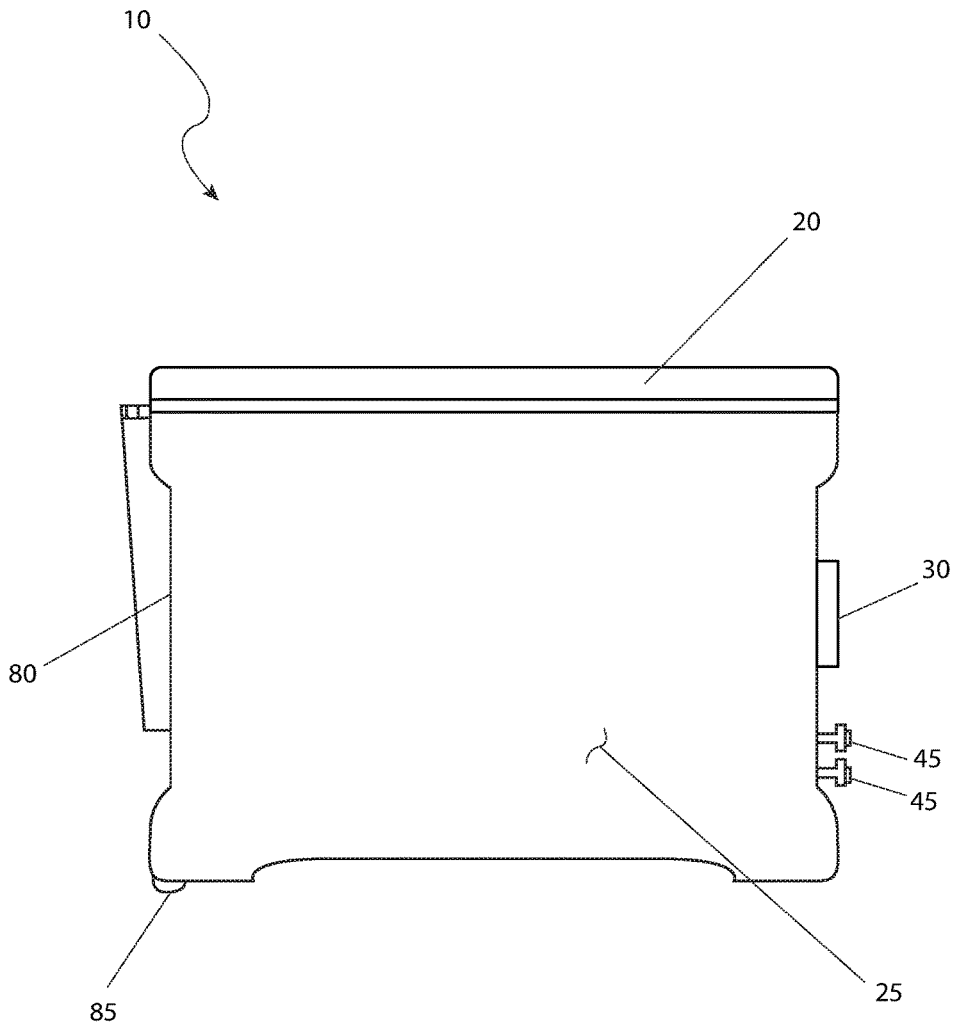
FIG. 5 is a left-side view of the portable beverage and ice dispenser 10, according to the preferred embodiment of the present invention.

Referring now to FIG. 5, a left-side view of the device 10, according to the preferred embodiment of the present invention is disclosed. This figure clearly depicts the insulated sidewalls 25 as provided as part of the device 10. Note that the retractable pulling handle 80 and caster wheels 85 as well as the removable lid 20, the ice dispenser 30, and the beverage dispensing spigots 45 are visible in this figure as well.

Figure 6:
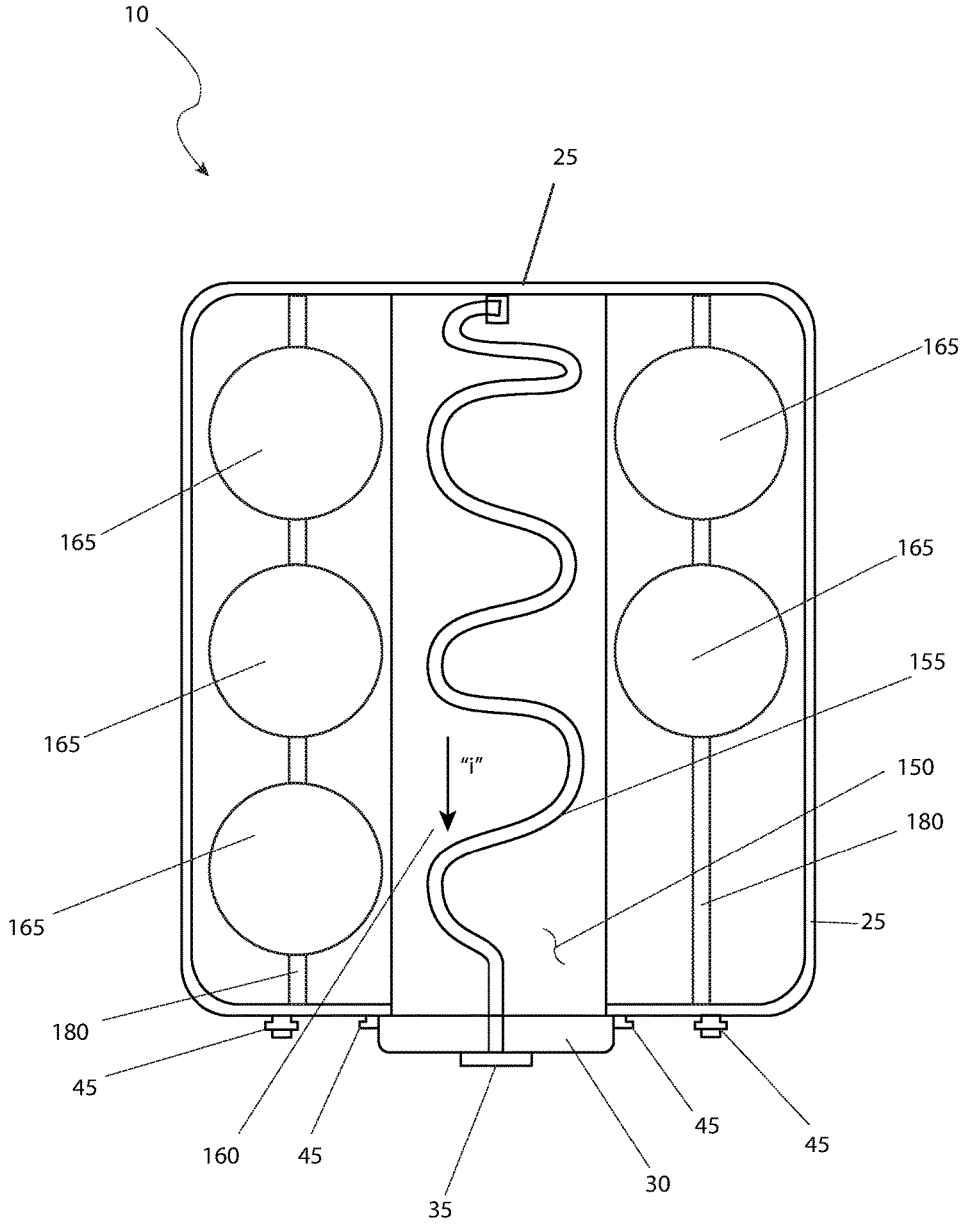
FIG. 6 is a section cut of the portable beverage and ice dispenser 10 as seen along a line I-I, as shown in FIG. 1, according to the preferred embodiment of the present invention; and, FIG. 7 is a section cut of the portable beverage and ice dispenser 10 as seen along a line II-II, as shown in FIG. 2, according to the preferred embodiment of the present invention.

Referring next to FIG. 6, a section cut of the device 10 as seen along a line I-I, as shown in FIG. 1, according to the preferred embodiment of the present invention is depicted. This figure provides vision of an ice reservoir 150 located in the center of the device 10. An ice drive mechanism 155 pushes ice cubestowards the dispensing knob 35 as the ice dispenser 30 is turned. A series of five (5) beverage reservoirs 165 are provided on the interior of the device 10 with three (3) on the left side and two (2) on the right side. Each of the beverage reservoirs 165 are connected respectively to the beverage dispensing spigots 45. The reservoirs would hold: cola, lemon/lime soft drink, orange juice, water, sweet and sour mix, seltzer, and the like according to the user's preferences. Further detail on the interconnection of the beverage reservoirs 165 to the beverage dispensing spigots 45 will be provided herein below.

Figure 7:
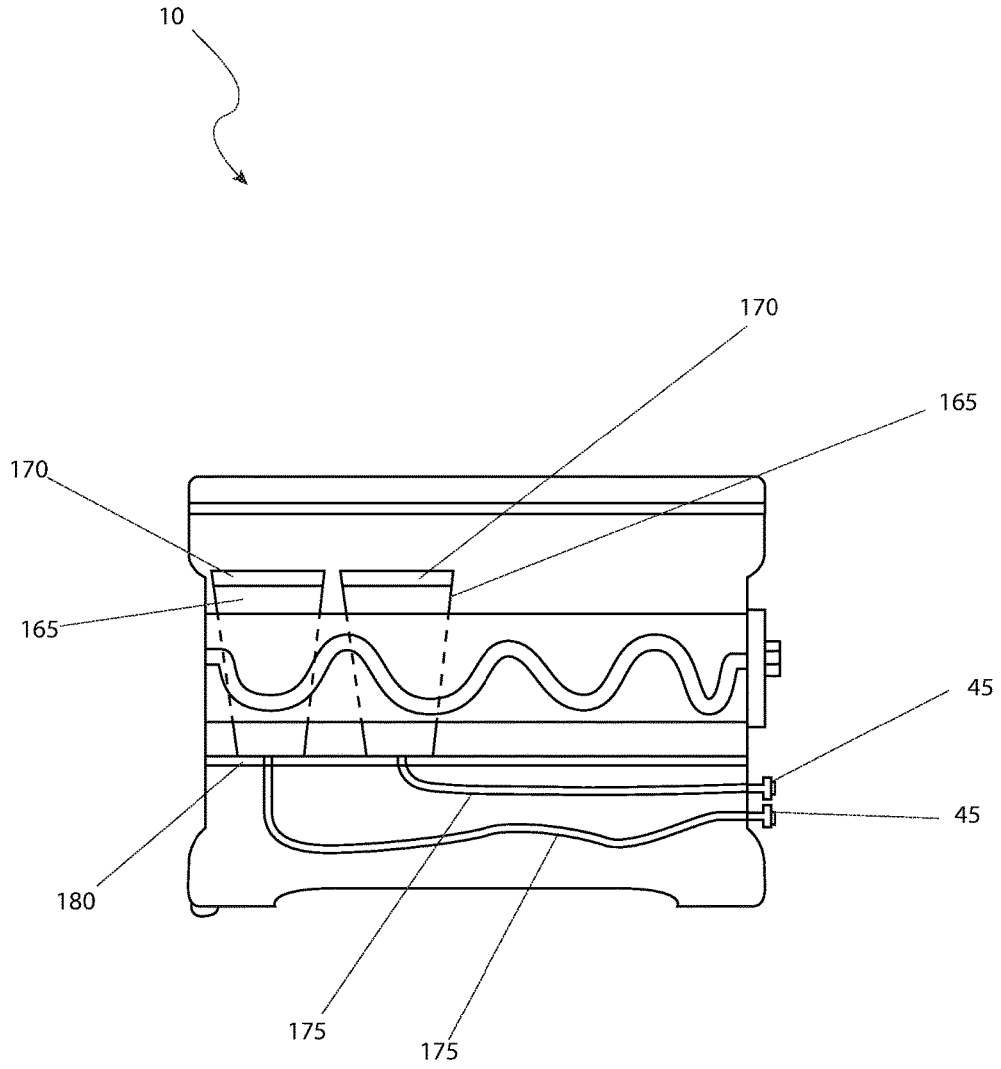

Referring finally to FIG. 7, a section cut of the device 10 as seen along a line II-II, as shown in FIG. 2, according to the preferred embodiment of the present invention is shown. This figure depicts the left side of the device 10 as shown in FIG. 6. Two (2) of the beverage reservoirs 165 are visible along with reservoir covers 170 to provide protection against dirt and debris. A series of connection tubes 175 connect each of the beverage reservoirs 165 to the respective beverage dispensing spigots 45. The contained beverage in each beverage reservoirs 165 flows by gravity. Each beverage reservoirs 165 is held in place by a support rod 180 which serves as a support stand.

The preferred embodiment of the present invention can be utilized by the common user in a simple and effortless manner with little or no training. It is envisioned that the portable beverage and ice dispenser 10 would be constructed in general accordance with FIG. 1 through FIG. 7. After acquisition of the device 10 it would be washed and rinsed to ensure sanitary conditions. Next, the user would fill each of the beverage reservoirs 165 with the desired beverage. The reservoir covers 170 would then be placed in position on each of the beverage reservoirs 165. The user would then fill the ice reservoir 150 with ice cubes as well as place ice cubes around and under the beverage reservoirs 165. The desired number of disposable cups 100 would then be placed in holding tube 110. At this point in time the device 10 is ready for use.

During use of the device 10 it is transported to the desired usage location by user of the retractable pulling handle 80 and the caster wheels 85. The extendable folding legs 90 would then be deployed (if needed) to raise the device 10 to an acceptable and ready to use height. A disposable cup 100 is removed from the cup dispenser 65 and filled with ice using the ice dispenser 30. The desired amount of alcohol (if used) is then placed in the disposable cups 100. To complete the filling of the disposable cups 100, the user would utilize the desired beverage dispensing spigots 45 by pressing the respective spring loaded dispensing knob 50 to dispense the desired beverage from the spout opening 55. Finally, the beverage is mixed with the drink stirrer 70 by placing the stirring rod 140 in the disposable cups 100 and turning the upper crank handle 135. This process is repeated as needed at a particular usage event or when the beverage reservoirs 165 or ice reservoir 150 is depleted.

After use of the device 10, all remaining ice and beverage is emptied and all components are washed, rinsed and dried. This process is then repeated during each usage cycle in a repeating fashion.

The foregoing descriptions of specific embodiments of the present invention have been presented for purposes of illustration and description. They are not intended to be exhaustive or to limit the invention to the precise forms disclosed, and obviously many modifications and variations are possible considering the above teaching. The embodiments were chosen and described in order to best explain the principles of the invention and its practical application, to thereby enable others skilled in the art to best utilize the invention and various embodiments with various modifications as are suited to the use contemplated.

What is claimed is:

1. A portable beverage dispenser, comprising:

an insulated cooler body having a cooler body interior;

a lid removably secured over a cooler body open top;

a handle assembly affixed to a cooler body first sidewall;

an ice reservoir located within said cooler body interior, having an ice reservoir interior;

an ice dispenser in operable communication with said ice reservoir interior and in fluid communication with an ice dispenser opening disposed within a cooler body second sidewall;

at least one beverage dispensing assembly, each comprising:

a beverage reservoir located within said cooler body interior and outside said ice reservoir; and, a dispensing device in operable communication with said beverage reservoir and in fluid communication with a beverage dispensing opening located on said cooler body second sidewall;

at least one drawer slidably engaging with said cooler body second sidewall;

a cup dispenser affixed to a cooler body third sidewall; and, a drink stirrer affixed to said cooler body third sidewall adjacent said cup dispenser.

2. The portable beverage dispenser of claim 1, wherein said ice dispenser further comprises:

an ice drive mechanism disposed within said ice reservoir interior; and, an ice drive mechanism knob in mechanical communication with said ice drive mechanism;

wherein said ice drive mechanism knob is disposed on said cooler body second side wall superjacent said ice dispenser opening; and, wherein when said ice drive mechanism knob is actuated in a first direction, said ice drive mechanism directs a unit of ice within said ice reservoir interior towards said ice dispenser opening.

3. The portable beverage dispenser of claim 1, wherein each said beverage reservoir is supported by at least one support rod.

4. The portable beverage dispenser of claim 1, wherein an upper surface of said lid further comprises at least one recessed beverage container holder.

5. The portable beverage dispenser of claim 1, further comprising at least one leg, each attached to a bottom of said cooler body and capable of being deployed between an extended state and a stowed state.

6. The portable beverage dispenser of claim 1, wherein said handle assembly is retractable.

7. The portable beverage dispenser of claim 5, further comprising a pair of caster wheels attached to a first edge of said bottom of said cooler body.

8. The portable beverage dispenser of claim 1, wherein said cup dispenser further comprises:

a first bracket secured to said cooler body third sidewall; and, a holding tube secured within said first bracket;

wherein a quantity of cups are removably secured within said holding tube.

9. The portable beverage dispenser of claim 7, wherein said drink stirrer comprises:

a second bracket secured to said cooler body third sidewall adjacent said first bracket;

a stirring rod moveably secured within said second bracket; and, a handle secured to a stirring rod upper end.

10. The portable beverage dispenser of claim 3, wherein each said beverage reservoir has a corresponding beverage reservoir lid capable of securing about an upper opening thereof.

11. A portable beverage dispenser, comprising:

an insulated cooler body having a cooler body interior;

a lid removably secured over a cooler body open top;

a handle assembly exteriorly affixed to a cooler body first sidewall;

an ice reservoir located within said cooler body interior, having an ice reservoir interior;

an ice dispenser in operable communication with said ice reservoir interior and in fluid communication with an ice dispenser opening disposed within a cooler body second sidewall;

at least one beverage dispensing assembly, each comprising:

a beverage reservoir located within said cooler body interior and outside said ice reservoir;

a dispensing device in fluid communication with a beverage dispensing opening located on said cooler body second sidewall; and, a spring-loaded knob in operable communication with said beverage reservoir;

at least one drawer slidably engaging with said cooler body second sidewall;

a cup dispenser affixed to a cooler body third sidewall; and, a drink stirrer affixed to said cooler body third sidewall adjacent said cup dispenser;

wherein when said knob is actuated in a first direction, a beverage within said beverage reservoir is dispensed through a spout.

12. The portable beverage dispenser of claim 11, wherein said ice dispenser further comprises:

an ice drive mechanism disposed within said ice reservoir interior; and, an ice drive mechanism knob in mechanical communication with said ice drive mechanism;

wherein said ice drive mechanism knob is disposed on said cooler body second side wall superjacent said ice dispenser opening; and, wherein when said ice drive mechanism knob is actuated in a first direction, said ice drive mechanism directs a unit of ice within said ice reservoir interior towards said ice dispenser opening.

13. The portable beverage dispenser of claim 11, wherein each said beverage reservoir is supported by at least one support rod.

14. The portable beverage dispenser of claim 11, wherein an upper surface of said lid further comprises at least one recessed beverage container holder.

15. The portable beverage dispenser of claim 11, further comprising at least one leg, each attached to a bottom of said cooler body and capable of being deployed between an extended state and a stowed state.

16. The portable beverage dispenser of claim 11, wherein said handle assembly is retractable.

17. The portable beverage dispenser of claim 15, further comprising a pair of caster wheels attached to a first edge of said bottom of said cooler body.

18. The portable beverage dispenser of claim 11, wherein said cup dispenser further comprises:

a first bracket secured to said cooler body third sidewall; and, a holding tube secured within said first bracket;

wherein a quantity of cups are removably secured within said holding tube.

19. The portable beverage dispenser of claim 17, wherein said drink stirrer comprises:

a second bracket secured to said cooler body third sidewall adjacent said first bracket;

a stirring rod moveably secured within said second bracket; and, a handle secured to a stirring rod upper end.

20. The portable beverage dispenser of claim 13, wherein each said beverage reservoir has a corresponding beverage reservoir lid capable of securing about an upper opening thereof.

* * * * *